US005100772A

United States Patent [19]

Chen et al.

[11] Patent Number: 5,100,772

[45] Date of Patent: Mar. 31, 1992

[54] MAGENTA DYE FORMING COUPLER FOR PHOTOGRAPHIC MATERIAL

[75] Inventors: Tienteh Chen, Penfield; Stanley W. Cowan, Rochester; Edward Schofield, Penfield; Ping W. Tang, Rochester, all of N.Y.

[73] Assignee: Eastman Kodak Company, Rochester, N.Y.

[21] Appl. No.: 633,722

[22] Filed: Dec. 24, 1990

[51] Int. Cl.[5] ..... G03C 7/327; G03C 7/38

[52] U.S. Cl. ..... 430/548; 430/558

[58] Field of Search ..... 430/558, 548, 386, 387

[56] References Cited

U.S. PATENT DOCUMENTS 4,639,413 1/1987 Kawagishi et al. ..... 430/546
4,900,655 2/1990 Nakazyo et al. ..... 430/546

FOREIGN PATENT DOCUMENTS 0285274 10/1988 European Pat. Off. ..... 430/558
0294681 12/1988 European Pat. Off. .
1142632 6/1989 Japan ..... 430/558

*Primary Examiner*—Charles L. Bowers, Jr.
*Assistant Examiner*—Lee C. Wright
*Attorney, Agent, or Firm*—Joshua G. Levitt

[57] ABSTRACT

A magenta dye-forming coupler for photographic material is disclosed. The coupler is a polymer derived from a monomer having the formula:

(I)

$R_1$ represents hydrogen or a substituent,

X represents hydrogen or a group capable of being released by a coupling reaction with an oxidized aromatic primary amine developing agent, Z represents the atoms necessary to complete a heterocyclic ring, L represents a divalent linking group, A represents —CONH—, —COO—, —O—, —OOC—, —NHCO—, —NHCONH—, —$NHSO_2$—, or a substituted or unsubstituted phenylene group, D represents —O—, —NR″—, or —CONR″—, R represents a substituted or unsubstituted aliphatic or a substituted or unsubstituted aromatic substituent, having at least 6 carbon atoms, R′ represents H, substituted or unsubstituted lower alkyl of from 1 to 4 carbon atoms, carboxyl, or halogen, and R″ represents substituted or unsubstituted: alkyl, aryl, or acetyl.

7 Claims, No Drawings

MAGENTA DYE FORMING COUPLER FOR PHOTOGRAPHIC MATERIAL

FIELD OF THE INVENTION

This invention relates to photography, and particularly to dye-forming couplers used in color silver halide photographic materials.

BACKGROUND OF THE INVENTION

Color silver halide photographic materials rely on coupler compounds to form dyes that make up the image recorded in such materials. Usually a yellow dye-forming coupler will be associated with a blue-sensitive silver halide emulsion layer, a magenta dye-forming coupler will be associated with a green-sensitive silver halide emulsion layer, and a cyan dye-forming coupler will be associated with a red sensitive silver halide emulsion layer. These coupler compounds form image dyes by reaction with color developer compound (e.g., phenylene diamine) that has been oxidized by reaction with exposed silver halide.

One well known class of magenta dye forming couplers are pyrazoloazole couplers according to the general formula:

(II)

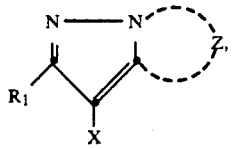

wherein $R_1$ represents hydrogen or a substituent,

X represents hydrogen or a group capable of being released by a coupling reaction with an oxidized aromatic primary amine developing agent, and Z represents the non-metallic atoms necessary to complete a heterocyclic ring.

It is often desirable adjust the reactivity of such couplers by attaching various ballast groups to the Z ring of the above described pyrazoloazole couplers. One such coupler has the formula:

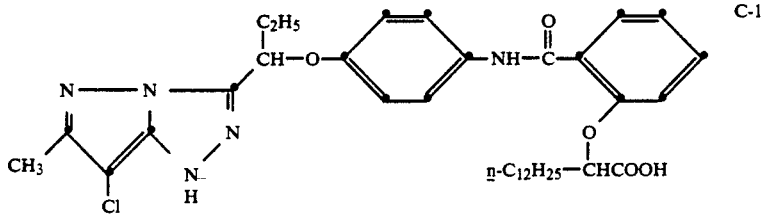

C-1

It is also often desirable to attach pyrazoloazole couplers to polymeric chains. This can provide a variety of advantages, such as reduced wandering, reduced crystallinity, and thinner layers. However, when couplers such as C-1 above are attached to a polymeric chain, as with a polymerized version of the monomer shown below:

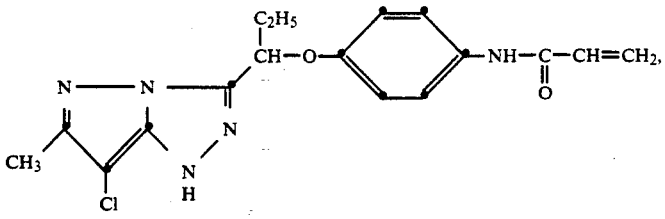

C-2 the polymeric coupler exhibits a high level of inhibition of silver development. This reduces the effective speed of the silver halide emulsion. Also, many polymeric couplers, such as C-2, are still subject to wandering.

It is therefore desirable to provide a polymeric pyrazoloazole coupler that has the desired reactivity, and does not suffer from undue inhibition of silver development.

SUMMARY OF THE INVENTION

According to the present invention, there is provided a photographic element comprising a support having thereon at least one silver halide emulsion layer having associated therewith a polymeric magenta dye-forming coupler derived from a monomer having the formula:

(I)

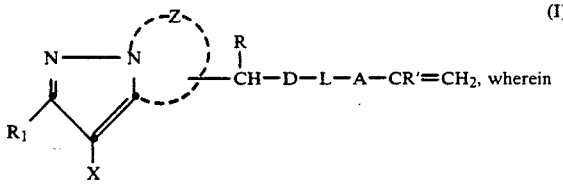

$R_1$ represents hydrogen or a substituent,

X represents hydrogen or a group capable of being released by a coupling reaction with an oxidized aromatic primary amine developing agent, Z represents the atoms necessary to complete a heterocyclic ring, L represents a divalent linking group, A represents —CONH—, —COO—, —O—, —OOC—, —NHCO—, —NHCONH—, —$NHSO_2$—, or a substituted or unsubstituted phenylene group, D represents —O—, —NR″—, or —CONR″—, R represents a substituted or unsubstituted aliphatic or a substituted or unsubstituted aromatic substituent, having at least 6 carbon atoms, R' represents H, substituted or unsubstituted lower alkyl of from 1 to 4 carbon atoms, carboxyl, or halogen, and R'' represents substituted or unsubstituted: alkyl, aryl, or acetyl.

The polymeric coupler derived from the monomer of formula (I) exhibits good activity and low inhibition of silver development. The couplers of formula (I) also tend to exhibit good hue characteristics.

DESCRIPTION OF THE PREFERRED EMBODIMENTS

According to formula (I), $R_1$ represents hydrogen or a substituent. When $R_1$ is a substituent, it can be chosen from any of a number of well-known substituents for that position of a pyrazoloazole coupler, and is chosen so as to be compatible with the desired characteristics (e.g., activity, hue) of the coupler. Examples of substituents useful as $R_1$ include a substituted or unsubstituted alkyl group, (e.g., a methyl group, a propyl group, a t-butyl group, a trifluoromethyl group, a tridecyl group, a 3-(2,4-di-t-amylphenoxy) propyl group), a substituted or unsubstituted aryl group (e.g., a phenyl group, a 4-t-butylphenyl group, a 2,4,6-trimethylphenyl group), a substituted or unsubstituted heterocyclic group (e.g., a 2-furyl group, a 2-thienyl group), a cyano group, a substituted or unsubstituted alkoxy group (e.g., a methoxy group, an ethoxy group), a substituted or unsubstituted aryloxy group (e.g., a phenoxy group, a 2-methylphenoxy group), a substituted or unsubstituted heterocyclic oxy group (e.g., a 2-benzimidazolyloxy group), a substituted or unsubstituted acyloxy group (e.g., an acetoxy group, a hexadecanoyloxy group), a substituted or unsubstituted carbamoyloxy group (e.g., an N-phenylcarbamoyloxy group, an N-ethylcarbamoyloxy group), a substituted or unsubstituted silyloxy group (e.g., a trimethylsilyloxy group), a substituted or unsubstituted sulfonyloxy group (e.g., a dodecylsulfonyloxy group), a substituted or unsubstituted acylamino group (e.g., an acetamido group, a benzamido group), a substituted or unsubstituted anilino group (e.g., a phenylamino group, a 2-chloroanilino group), a substituted or unsubstituted ureido group (e.g., a phenylureido group, a methylureido group), a substituted or unsubstituted imido group (e.g., an N-succinimido group, a 3-benzylhydantoinyl group), a substituted or unsubstituted sulfamoylamino group (e.g., an N,N-dipropylsulfamoylamino group, an N-methyl-N-decylsulfamoylamino group), a substituted or unsubstituted carbamoylamino group (e.g., an N-butylcarbamoylamino group, an N,N-dimethylcarbamoylamino group), a substituted or unsubstituted alkylthio group (e.g., a methylthio group, an octylthio group), a substituted or unsubstituted arylthio group (e.g., a phenylthio group, a 2-butoxy-5-t-octylphenylthio group), a substituted or unsubstituted heterocyclic thio group (e.g., a 2-benzothiazolyl group), a substituted or unsubstituted alkoxycarbonylamino group (e.g., a methoxycarbonylamino group, a tetradecyloxy carbonylamino group), a substituted or unsubstituted aryloxycarbonylamino group (e.g., a phenoxycarbonylamino group, a 2,4-di-tert-butylphenoxycaronylamino group), a substituted or unsubstituted sulfonamido group (e.g., a methanesulfonamido group, a hexadecanesulfonamido group), a substituted or unsubstituted carbamoyl group (e.g., a N-ethylcarbamoyl group, an N,N-dibutylcarbamoyl group), a substituted or unsubstituted acyl group (e.g., an acetyl group, a (2,4-di-tert-amylphenoxy)acetyl group), a substituted or unsubstituted sulfamoyl group (e.g., an N-ethylsulfamoyl group, an N,N-dipropylsulfamoyl group), a substituted or unsubstituted sulfonyl group (e.g., a methanesulfonyl group, an octanesulfonyl group), a substituted or unsubstituted sulfinyl group (e.g., an octanesulfinyl group, a dodecylsulfinyl group), a substituted or unsubstituted alkoxycarbonyl group (e.g., a methoxycarbonyl group, a butyloxycarbonyl group), a substituted or unsubstituted aryloxycarbonyl group (e.g , a phenyloxycarbonyl group, a 3-pentadecyloxycarbonyl group), a substituted or unsubstituted alkenyl group, a substituted or unsubstituted carboxyl group, a substituted or unsubstituted sulfo group, a hydroxyl group, a substituted or unsubstituted amino group, or a substituted or unsubstituted carbonamido group. The substituents for these groups include a halogen atom, an alkyl group, an aryl group, a heterocyclic group, a cyano group, an alkoxy group, an aryloxy group, a heterocyclicoxy group, an acyloxy group, a carbamoyloxy group, a silyloxy group, a sulfonyloxy group, an acylamino group, an anilino group, a ureido group, an imido group, a sulfonylamino group a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, an aryloxycarbonyl group, an alkenyl group, a carboxyl group, a sulfo group, a hydroxyl group, an amino group, and a carbonamido group, etc. $R_1$ preferably represents an alkyl group, an aryl group, a carbonamido group, a sulfonamido group, a ureido group, a sulfone group, a thio group, or a sulfoxide group.

X represents a hydrogen atom or a group capable of being released by a coupling reaction with an oxidized aromatic primary amine developing agent (hereinafter referred to as a coupling-off group). Coupling-off groups are known in the art and may include a group containing an aliphatic group, an aromatic group, a heterocyclic group, an aliphatic, aromatic, or heterocyclic sulfonyl group, or an aliphatic, aromatic, or he&erocyclic carbonyl group that is bonded to the coupling active carbon via an oxygen atom, a nitrogen atom, a sulfur atom, or a carbon atom, a halogen atom, an aromatic azo group, and the like. The aliphatic, aromatic, or heterocyclic group contained in such coupling-off groups may have one or more substituents, as described above for $R_1$.

Examples of coupling-off groups include a halogen atom (e.g., fluorine, chlorine, bromine), an alkoxy group (e.g., ethoxy, dodecyloxy, carboxypropyloxy), an aryloxy group (e.g., 4-chlorophenoxy group, a 4-methoxyphenoxy group), an acyloxy group (e.g., an acetoxy group, a tetradecanoyloxy group), an aliphatic or aromatic sulfonyloxy group (e.g., a methanesulfonyloxy group, a toluenesulfonyloxy group), an acylamino group (e.g., a dichloroacetylamino group, a trifluoroacetylamino group), an aliphatic or aromatic sulfonamido group (e.g., a methanesulfonamido group, a p-toluenesulfonamide group), an alkoxycarbonyloxy group (e.g., an ethoxycarbonyloxy group, a benzyloxycarbonyloxy group), an aryloxycarbonyloxy group (e.g., a phenoxycarbonyloxy group), an aliphatic, aromatic or heterocyclic thio group (e.g., an ethylthio group, a phenylthio group), a carbamoylamino group (e.g., an N-methylcarbamoylamino group, an N-phenylcarbamoylamino group), a 5-membered or 6-membered nitrogen-containing heterocyclic group (e.g., an imidazolyl group, a pyrazolyl group), an imido group (e.g., a succinimido group, a hydantoinyl group), an aromatic azo group (e.g., a phenylazo group), and the like. Some of these groups may have substituents selected from those described above for $R_1$.

Also according to formula (I), L represents an optional divalent linking group. The linking group L preferably comprises from 0 to 10 atoms, with from 0 to 10 atoms separating the oxygen atom from the A group in formula (I). Examples of linking groups useful for L include phenylene, mono or multisubstituted phenylene, such as

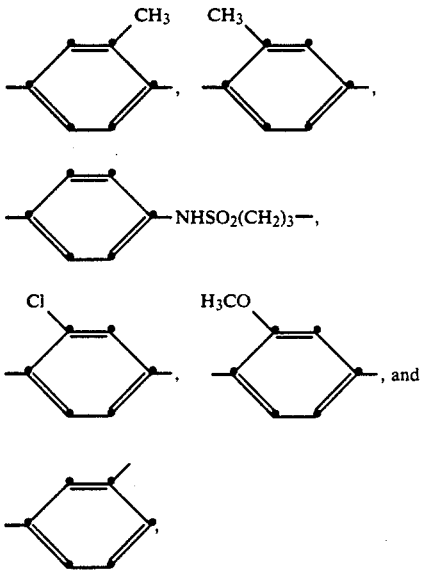

propylene, ethylene, butylene, and others, as would be known to one skilled in the art.

R represents a substituted or unsubstituted aliphatic or a substituted or unsubstituted aromatic substituent, having at least 6 carbon atoms. Examples of R include phenyl, substituted phenyl such as o-methylphenyl, p-methylphenyl, p-chlorophenyl, and straight and branched alkyls such as hexyl, octyl, nonyl, decyl, dodecyl, which may be substituted with well-known substituents, such as halogen (e.g., chloro), alkoxy, and the like.

R′ represents H, substituted or unsubstituted lower alkyl of from 1 to 4 carbon atoms, carboxyl, or halogen. R′ is preferably H or methyl.

R″ represents substituted or unsubstituted: alkyl (preferably of 1 to 15 carbon atoms), aryl (preferably of 6 to 15 carbon atoms), acetyl (preferably of 1 to 15 carbon atoms), or substituted or unsubstituted amido. Examples of R″ include substituted and unsubstituted alkyl and aryl groups as those described above for R and R′ (as well as 5-carbon alkyls), acetyl, $—COC_2H_5$, $—COC_3H_7$, $—COC_2H_4Cl$, $COC_2H_4COOH$, —CONH—ϕ—COOH.

A more specific expression of compounds according to formula (I) is made by reference to formula (II):

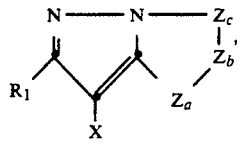

(II)

wherein $R_1$ and X are as described above, $Z_a$, $Z_b$, and $Z_c$ each represents a substituted or unsubstituted methine group, =N—, or —NH—, one of either the $Z_a$-$Z_b$ bond or the $Z_b$-$Z_c$ bond is a double bond with the other being a single bond, when the $Z_b$-$Z_c$ bond is a carbon-carbon double bond, it may form part of an aromatic ring, and at least one of $Z_a$, $Z_b$, and $Z_c$ represents a methine group substituted with:

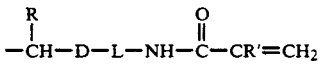

In one preferred embodiment, the monomer of formula (I) is represented by the formula:

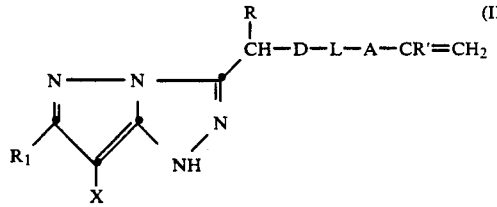

(III)

$R_1$, X, R, L, A, and R′ are as defined above.

In another preferred embodiment, the monomer of formula (I) is represented by the formula:

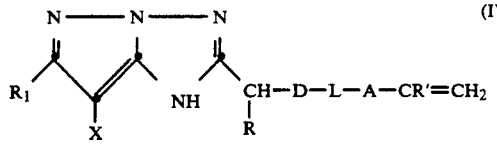

(IV)

Examples of monomers according to formula (I) useful in the practice of the invention include:

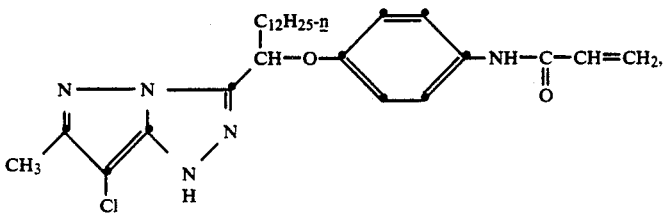

1

-continued
2
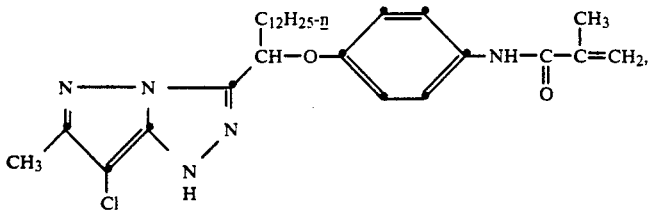
3
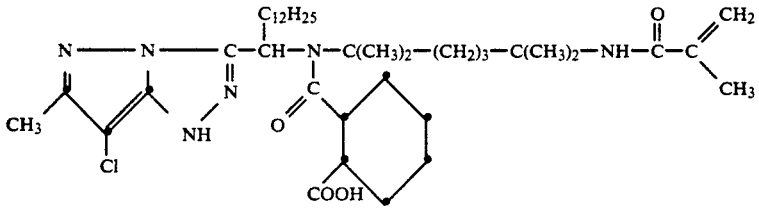
4
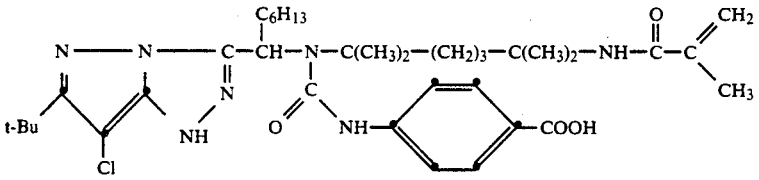
5
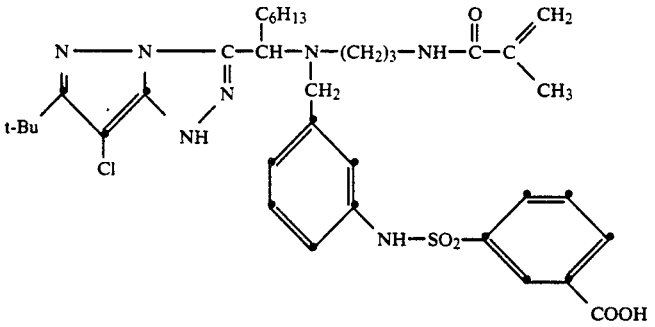
6
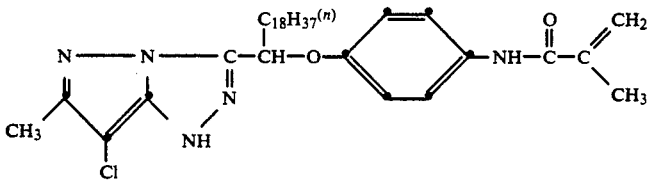
7
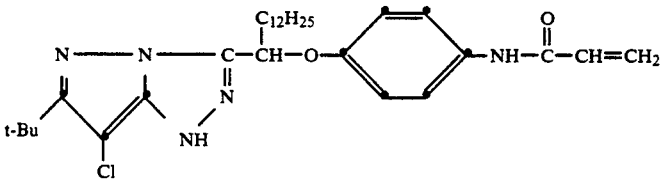

-continued
8
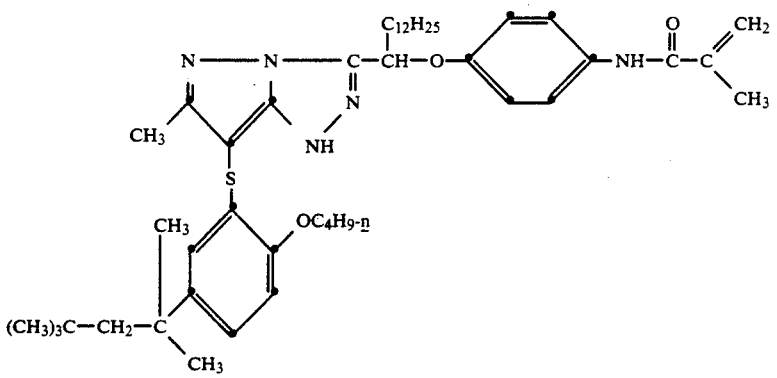
9
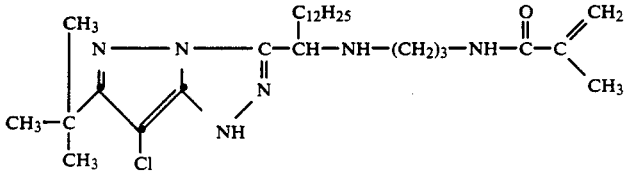
10
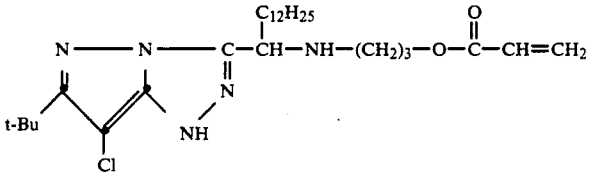
11
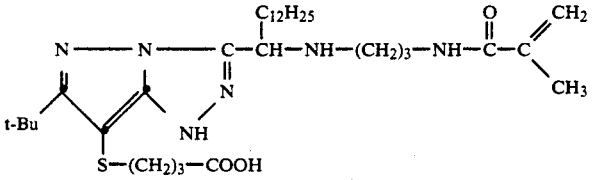
12
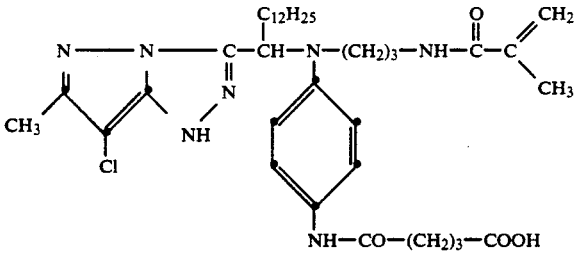
13
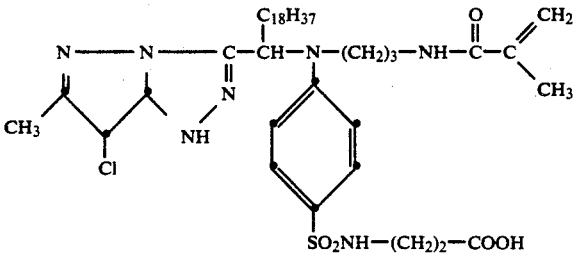

-continued
14
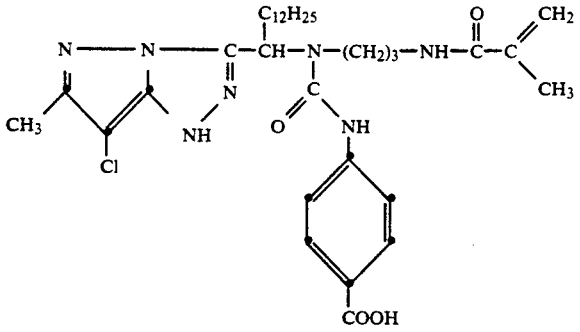
15
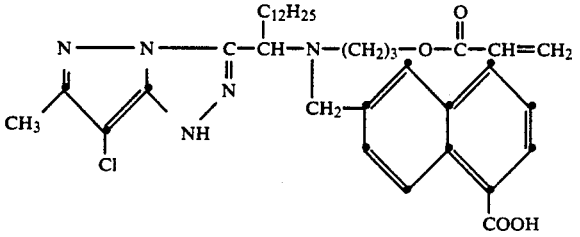
16
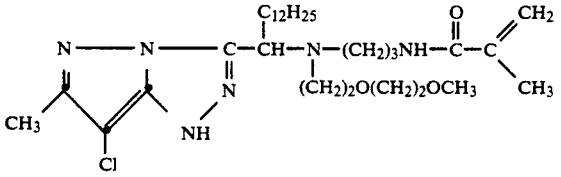
17
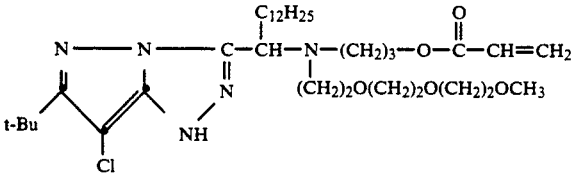
18
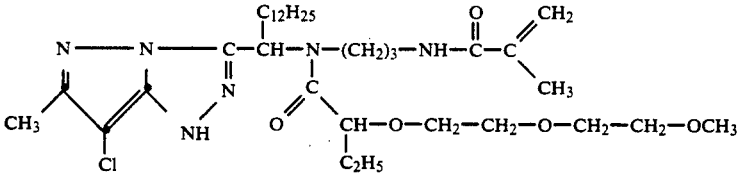
19
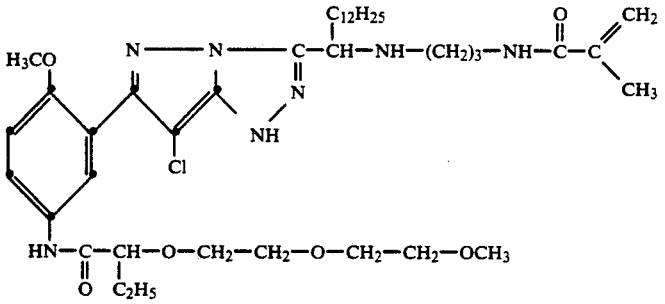
20
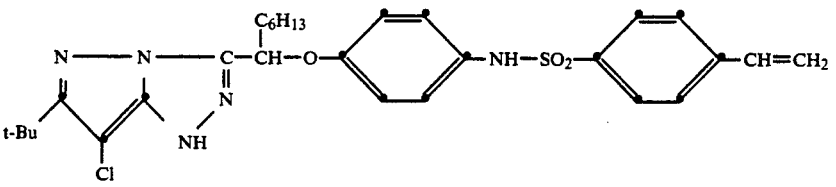

-continued
21
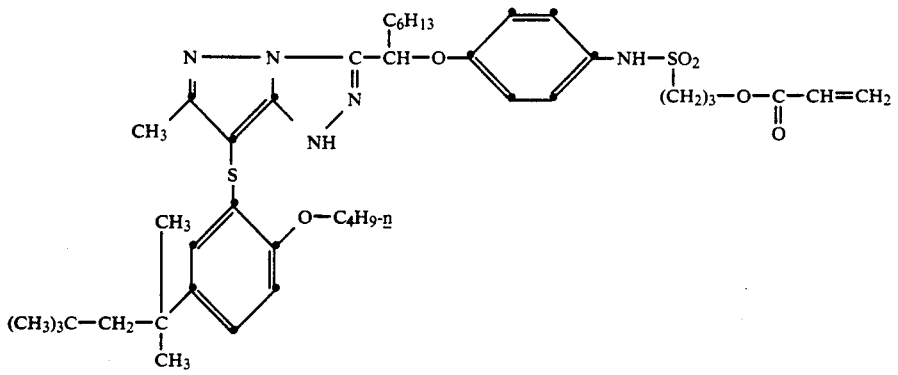
22
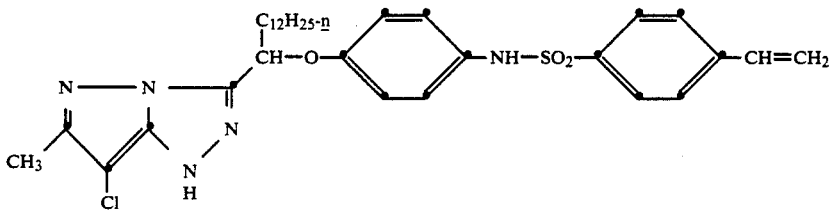
23
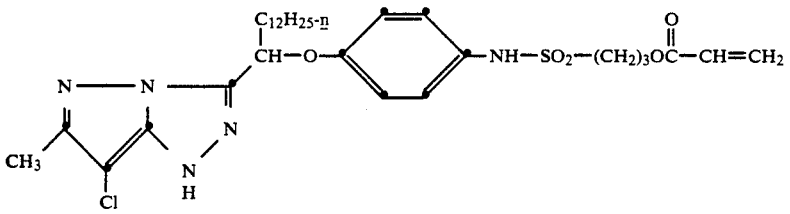
24
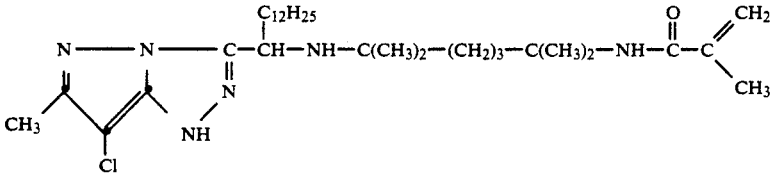
25
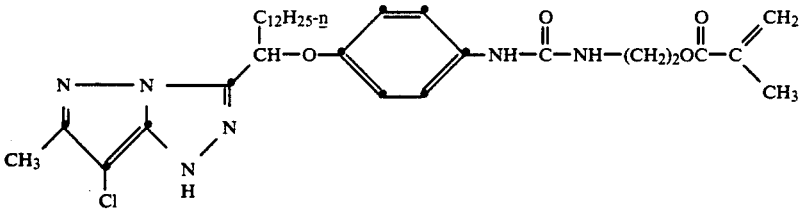
26
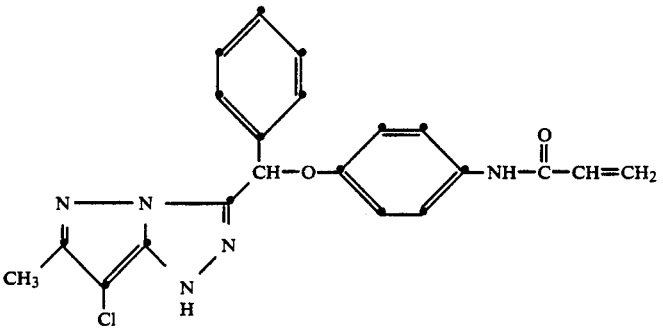

-continued

27

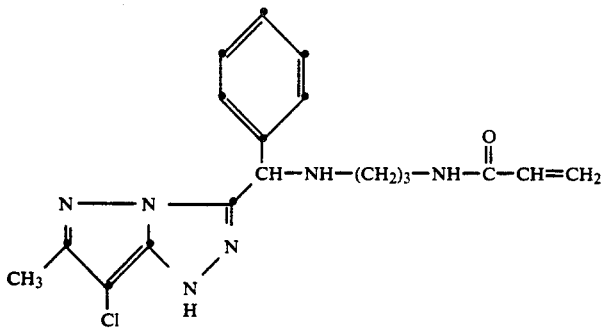

The support of the element of the invention can be any of a number of well-known supports for photographic elements. These include polymeric films such as cellulose esters (e.g., cellulose triacetate and diacetate) and polyesters of dibasic aromatic carboxylic acids with divalent alcohols (e.g., poly(ethylene terephthalate)), paper, and polymer-coated paper. Such supports are described in further detail in *Research Disclosure*, December, 1989, Item 308119 [hereinafter referred to as *Research Disclosure I*], Section XVII.

The silver halide emulsion used in the practice of the invention can contain for example, silver bromide, silver chloride, silver iodide, silver chlorobromide, silver chloroiodide, silver bromoiodide, or mixtures thereof. The emulsions can include coarse, medium, or fine silver halide grains bounded by 100, 111, or 110 crystal planes. Silver halide emulsions and their preparation are further described in *Research Disclosure I*, Section I. Also useful are tabular grain silver halide emulsions, as described in *Research Disclosure*, January, 1983, Item 22534 and U.S. Pat. No. 4,425,426.

The polymer derived from the pyrazoloazole coupler monomer of formula (I) (or mixtures of such couplers or mixtures with other magenta couplers) used in the practice of the invention can be incorporated in hydrophilic layers of photographic materials by techniques well known in the art. One common technique is by preparation of the polymer in the form of latex particles, which can be dispersed in hydrophilic coating compositions with the aid of surfactants and/or either volatile or permanent high-boiling organic solvents, as is known in the art. Alternatively, the polymer may be dissolved in a volatile or a permanent organic solvent, and dispersed as an "oil in-water" dispersion in gelatin. Useful volatile solvents include lower alkyl esters, lower alkyl ethers, ketones, halogenated hydrocarbons (e.g., methylene chloride), and others disclosed in JP 58/224352. Useful permanent organic solvents include tricresyl phosphates, di-n-butyl phthalate, and others described in *Research Disclosure I*, Section XIV. Surfactants are well-known to one skilled in the art, and are described in *Research Disclosure I*, Section XI. Mixtures of solvents and surfactants may also be used.

The silver halide described above can be sensitized to a particular wavelength range of radiation, such as the red, blue, or green portions of the visible spectrum, or to other wavelength ranges, such as ultraviolet, infrared, and the like. In a preferred embodiment, the silver halide emulsion associated with the pyrazoloazole coupler is spectrally sensitized to green light so as to complement the magenta color of the dye formed by the coupler during processing. Chemical sensitization of silver halide can be accomplished with chemical sensitizers such as gold compounds, iridium compounds, or other group VIII metal compounds. Spectral sensitization is accomplished with spectral sensitizing dyes such as cyanine dyes, merocyanine dyes, styryls, or other known spectral sensitizers. Additional information on sensitization of silver halide is described in *Research Disclosure I*, Sections I–IV.

The photographic element of the invention may be a negative or a reversal element. It may also be a color element or monochromatic. Multicolor photographic elements according to the invention generally comprise a blue-sensitive silver halide layer having a yellow color-forming coupler associated therewith, a green-sensitive layer having a magenta color-forming coupler associated therewith. and a red-sensitive silver halide layer having a cyan color forming coupler associated therewith. Color photographic elements and color forming couplers are well-known in the art and are further described in *Research Disclosure I*, Section VII.

The element of the invention can also include any of a number of other well-known additives and layers, as described in *Research Disclosure I*. These include, for example, optical brighteners, antifoggants, oxidized developer scavengers, development accelerators, image stabilizers, light absorbing materials such as filter layers or intergrain absorbers, light scattering materials, gelatin hardeners, coating aids and various surfactants, overcoat layers, interlayers and barrier layers, antistatic layers, plasticizers and lubricants, matting agents, development inhibitor releasing couplers, bleach accelerator-releasing couplers, and other additives and layers known in the art.

The photographic elements of the invention, when exposed, are processed to yield an image. Processing can be by any type of known photographic processing, as described in *Research Disclosure I*, Sections XIX–XXIV. A negative image can be developed by color development with a chromogenic developing agent followed by bleaching and fixing. A positive image can be developed by first developing with a non-chromogenic developer, then uniformly fogging the element, and then developing with a chromogenic developer.

Bleaching and fixing can be performed with any of the materials known to be used for that purpose. Bleach baths generally comprise an aqueous solution of an oxidizing agent such as water soluble salts and complexes of iron (III) (e.g., potassium ferricyanide, ferric chloride, ammonium of potassium salts of ferric ethylenediaminetetraacetic acid), water-soluble persulfates (e.g., potassium, sodium, or ammonium persulfate), water soluble dichromates (e.g., potassium, sodium, and lithium dichromate), and the like. Fixing baths generally comprise an aqueous solution of compounds that form soluble salts with silver ions, such as sodium thiosulfate, ammonium thiosulfate, potassium thiocyanate, sodium thiocyanate, thiourea, and the like.

The invention is further illustrated by the following Example:

EXAMPLE

Photographic elements were prepared in the following format:

| | |
|---|---|
| Gelatin | 2.69 g/m$^2$ |
| Bis-vinyl sulfonylmethyl ether | 1.75% of total gel |
| Gelatin | 3.77 g/m$^2$ |
| Coupler | 1.6 mmole/m$^2$ |
| green-sensitized AgBrI (12% I) 3D grains, 0.55 μm | 0.90 g/m$^2$ |
| 5-methyl-s-triazole[2,3-a]-pyrimidine-7-ol, sodium salt | 35 mg/mole Ag |
| SUPPORT | |

The film was exposed to green light through a step wedge and processed in a C-41 ® process at 38° C. as shown below:

| Solution | Time (min:sec) | Agitation |
|---|---|---|
| Color Developer | Variable | $N_2$ Burst |
| Stop Bath | 0:30 | $N_2$ Burst |
| Wash | 2:00 | None |
| Bleach | 4:00 | Air |
| Wash | 3:00 | None |
| Fixer | 4:00 | $N_2$ Burst |
| Wash | 3:00 | None |
| Kodak Photoflo ® Soln. | 1:00 | None |

Development times of 1.5, 2, 2.5, 3.25, and 5 minutes were used.

Densities of the processed strips were measured by Status M densitometry and plotted against the logarithm of the relative exposure. The lowest density value was recorded as "Fog." The relative exposure value at the intersect of the extrapolated straight-line portion of the curve and the "Fog" density was recorded as the "Speed." For each coating, the speed values derived for each of the five development times were plotted against the five fog values and the speed at a constant fog level of 0.11 was determined.

Additional, similarly exposed strips were processed in the same manner, using a development time of 3.25 minutes, except that the bleach and the following wash were omitted. These strips were analyzed for developed silver using X-ray fluorescence spectrometry. The value reported ("Ag-max") is the amount of developed silver (in mg per square meter of film) in the step which received the highest exposure.

The compositions of the polymeric couplers tested and the test data are tabulated below:

| Coupler | Polymer Composition | Ag-max @ 3.25' | Speed @ 3.25' | Fog @ 3.25' | Speed @ 0.11 fog |
|---|---|---|---|---|---|
| 1 | Coupler:B:Auda 40:20:40 (wt.) | 348 | 272 | 0.08 | 274 |
| 1 | Coupler:Oe:Wna 40:50:5 (wt.) | 341 | 272 | 0.15 | 272 |
| C-2 | Coupler:B:Auda 40:30:30 (wt.) | 323 | 264 | 0.21 | 249 |
| C-2 | Coupler:B:Auda 40:25:35 (wt.) | 291 | 264 | 0.25 | 249 |
| C-3 | Non-polymeric | 290 | 261 | 0.14 | 256 |

It can be seen from these examples that more silver was developed in the coatings containing the polymeric couplers containing Coupler 1 than in the comparative examples. It can also be seen that the speeds for those same coatings was higher than those of the comparative examples, especially when the speeds are normalized for fog.

The other monomers used in the examples listed are:

B: n-Butyl acrylate

Oe: (2-ethoxyethyl) acrylate

Auda: 11-acrylamidoundecanoic acid

Wna: 2-acrylamido 2-methylpropanesulfonic acid sodium salt

The structure for comparison coupler C-3 is:

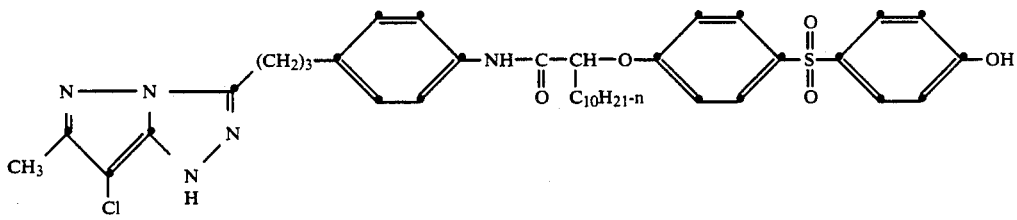

The invention has been described in detail with particular reference to preferred embodiments thereof, but it will be understood that variations and modifications can be effected within the spirit and scope of the invention.

What is claimed is:

1. A photographic element comprising a support having thereon at least one silver halide emulsion layer having associated therewith a polymeric magenta dye-forming coupler derived from a monomer having the formula:

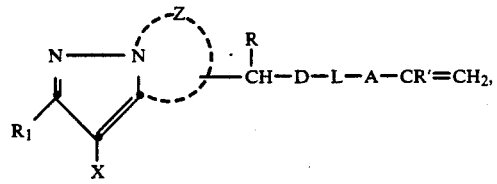

wherein $R_1$ represents hydrogen or a substituent,

X represents hydrogen or a group capable of being released by a coupling reaction with an oxidized aromatic primary amine developing agent, Z represents the atoms necessary to complete a heterocyclic ring, L represents a divalent linking group, A represents —CONH—, —COO—,—O—, —OOC—, —NHCO—, —NHCONH—, —NH-$SO_2$—, or a substituted or unsubstituted phenylene group, D represents —O—, —NR″—, or —CONR″—, R represents a substituted or unsubstituted aliphatic or a substituted or unsubstituted aromatic substituent, having at least 6 carbon atoms, R′ represents H, substituted or unsubstituted lower alkyl of from 1 to 4 carbon atoms, carboxyl, or halogen, and R″ represents substituted or unsubstituted: alkyl, aryl, or acetyl.

2. A photographic element according to claim 1 wherein R has at least 10 carbon atoms.

3. A photographic element according to claim 1 wherein R has at least 12 carbon atoms.

4. A photographic element according to claim 1 wherein A represents —CONH—.

5. A photographic element according to any of claims 1–4 wherein

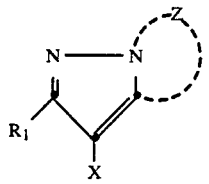

is represented by the formula:

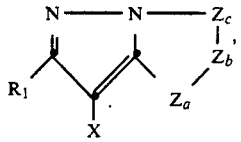

wherein $R_1$ represents hydrogen or a substituent,

X represents hydrogen or a group capable of being released by a coupling reaction with an oxidized aromatic primary amine developing agent, $Z_a$, $Z_b$, and $Z_c$ each represents a substituted or unsubstituted methine group, =N—, or —NH—, one of either the $Z_a$-$Z_b$ bond or the $Z_b$-$Z_c$ bond is a double bond with the other being a single bond, when the $Z_b$-$Z_c$ bond is a carbon-carbon double bond, it may form part of an aromatic ring, and at least one of $Z_a$, $Z_b$, and $Z_c$ represents a methine group substituted with:

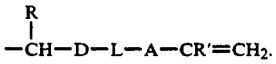

6. A photographic element according to any of claims 1–4 wherein said monomer has the formula:

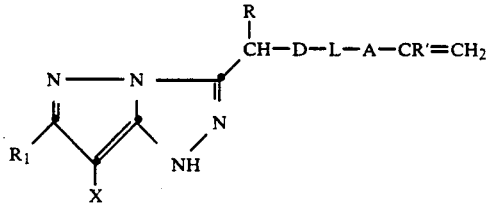

7. A photographic element according to any of claims 1–4 wherein said monomer has the formula:

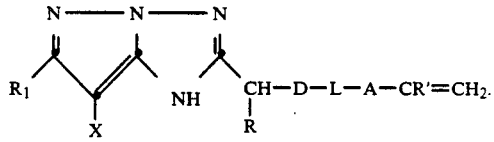

* * * * *